United States Patent [19]

Jenne, Jr. et al.

[11] 4,076,143

[45] Feb. 28, 1978

[54] RECTANGULAR SEAL BEAM LAMP UNIT

[75] Inventors: Frank Jenne, Jr., South Euclid; Denes Tarnay, Cleveland, both of Ohio

[73] Assignee: General Electric Company, Schenectady, N.Y.

[21] Appl. No.: 750,004

[22] Filed: Dec. 13, 1976

[51] Int. Cl.[2] ..... H01J 5/20

[52] U.S. Cl. ..... 220/2.1 R; 313/317

[58] Field of Search ..... 220/2.1 R, 2.1 A, 2.2, 220/2.3 R, 2.3 A; 65/36, 45, 54, 55; 313/315–318

[56] References Cited

U.S. PATENT DOCUMENTS

| | | | |
|---|---|---|---|
| 2,148,314 | 2/1939 | Wright | 220/2.1 R X |
| 2,761,990 | 9/1956 | Amdursky et al. | 220/2.1 A X |
| 2,764,810 | 10/1956 | Gardiner | 220/2.3 A X |
| 2,969,162 | 1/1961 | Stutske | 220/2.1 A |
| 3,071,280 | 1/1963 | Mayhew et al. | 220/2.1 A |
| 3,285,457 | 11/1966 | Peterson | 220/2.1 A |

*Primary Examiner*—Stephen Marcus

*Attorney, Agent, or Firm*—John F. McDevitt; Lawrence R. Kempton; Frank L. Neuhauser

[57] ABSTRACT

An improved rectangular shaped pressed glass sealed beam lamp unit is provided which includes a molded projection disposed at a particular location on the lens and reflector members to provide more reliable hermetic sealing when joined together at their peripheries. Specifically, the molded projections are provided on the back sealing surfaces of each rim region to reduce unwanted deformation which otherwise occurs when these members are initially formed by pressing the glass in molds. Said molded projections disappear for the most part during the aforesaid heat sealing assembly although the glass material remains in the rim region after joinder.

13 Claims, 2 Drawing Figures

RECTANGULAR SEAL BEAM LAMP UNIT

BACKGROUND OF THE INVENTION

The present invention relates to modification of the individual lens and reflector members in a rectangular shaped pressed glass seal beam lamp unit which has particular utility for automotive headlamps. Specifically, molded projections are formed in each of said members to resist glass deformation in the sealing regions when the individual members are initially pressed.

Sealed beam headlamps have been used in motor vehicles for some time and the previous conventional circular headlamps have a generally symmetrical parabolic shape which could be hermetically sealed without undue difficulty. The more recently introduced rectangular shaped headlamp unit has proven more difficult to fusion seal the individual lens and reflector members together by reason of deformities produced when said individual members are initially pressed in glass molds. These deformities interfere with proper registration of the individual members when the hermetic sealing subsequently takes place since the deformities can be sufficiently prominent to produce actual bowing of the glass member sides. The sealing problem is especially severe if such bowing results in a convex deformity in one member while the remaining member has a concave deformity so that it becomes important for all opposing sides of each member to maintain a reasonably parallel relationship.

SUMMARY OF THE INVENTION

It has now been dicovered, surprisingly, that such deformity of the individual lens and reflector members of a rectangular shaped pressed glass sealed beam lamp unit can be minimized for more reliable heat sealing together if the individual members include specific means to control thermal contraction in the sealing regions when the glass is formed. More particularly, deformation of the unmodified glass shapes is encountered in the sealing regions from thermal contraction while the glass is still in the molten state. The molten glass can be restrained from sagging in the rim regions with mold indentations which produce projections located on the back sealing surface intermediate the inner and outer rim edges. The remote location of such restraining elements does not interfere with heat sealing of the relatively narrow rim portions on the opposite front sealing surfaces.

In a preferred embodiment, the present molded projections have a segmented construction in the form of a plurality of elements disposed on the oppositely facing sides of the rectangular members. This configuration consists of two pairs of unequal length projection elements with one pair of approximately equal length elements being disposed on the longer sides of the rectangular shaped members in combination with a shorter but approximately equal length pair of elements being disposed on the shorter sides of the members. As has been previously mentioned, the hermetic sealing together of said modified lens and reflector members to form the final sealed beam lamp unit produces fusion of the glass material in the rim regions of both members so that the molded projections disappear by flowing into the sealing region. By locating the aforesaid projections so as not to physically alter the front sealing surfaces, there is no interference with the otherwise conventional sealing of the individual members together.

DESCRIPTION OF THE PREFERRED EMBODIMENT

Figure 1:
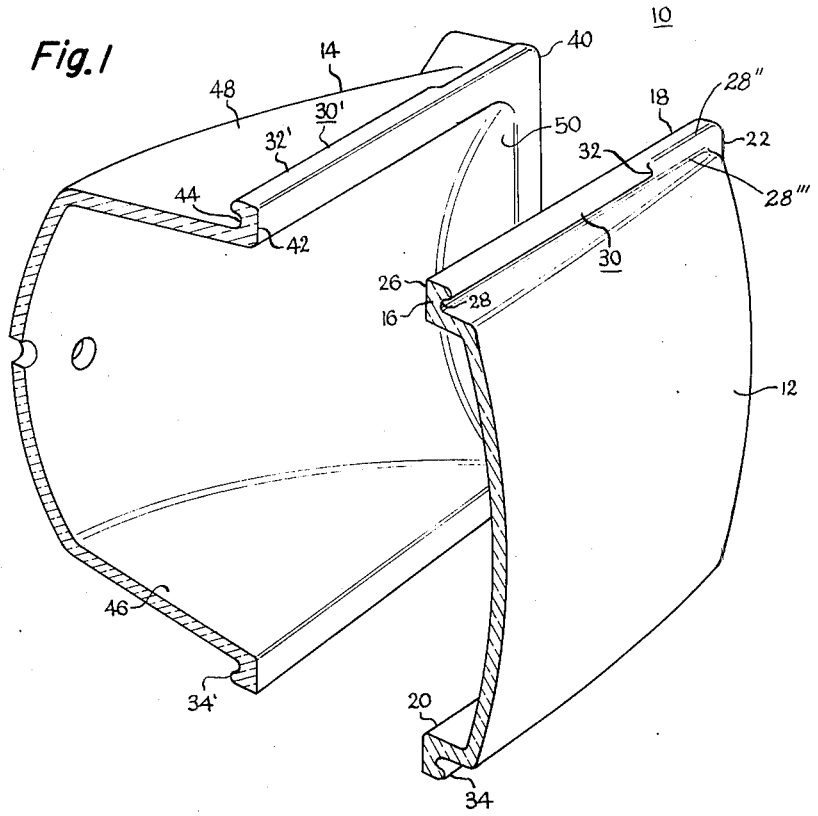
FIG. 1 is a perspective view partially in cross section of the improved rectangular shaped pressed glass sealed beam lamp unit of the present invention prior to final heat sealing.

Referring to the drawings, in FIG. 1, there is shown the principal pressed glass members of a sealed beam lamp unit 10 which includes a rectangular shaped glass lens member 12 and a rectangular shaped pressed glass reflector member 14 prior to heat sealing together. The glass lens member 12 includes a sealing rim 16 having a rectangular shape defined by longer opposing sides 18 and 20 which are joined by shorter opposing sides 22 and 24. The sealing rim 16 further includes front and back sealing surfaces 26 and 28, respectively, with said back sealing surface having disposed thereon a molded segmented projection 30 in the form of a plurality of oppositely disposed elements 32, 34, 36 and 38. (See FIG. 2). As can further be noted, the pair of projection elements 32 and 34 which are longitudinally disposed on the longer sides of the rectangular shaped member are of approximately equal length greater than the length of the approximately equal length elements 36 and 38 which are disposed on the shorter sides of said member. All of said projections can be noted to proceed rearwardly from the outer rim edge 28'' to the inner rim edge 28''' so as to lie intermediate said rim edges.

Correspondingly, the rectangular shaped reflector member 14 includes a sealing rim region 40 having a front sealing surface 42 and a back sealing surface 44 as well as a generally parallel relationship between the major sides of said member. The parallel relationship existing between the major sides 46 and 48 making up the longer sides of said rectangular construction is shown along with one of the shorter major sides 50 which intersects with said major longer sides. The back facing edge surface 44 of this pressed glass reflector member further includes the same type segmented molded projection 30' as has been previously described for the pressed glass lens member 12. Thus, rib elements 32' and 34' comprise a pair of oppositely disposed projection elements having approximately equal length longer than a second pair of oppositely disposed elements (not shown) located on the shorter sides of the rectangularly shaped reflector member 14.

Figure 2:
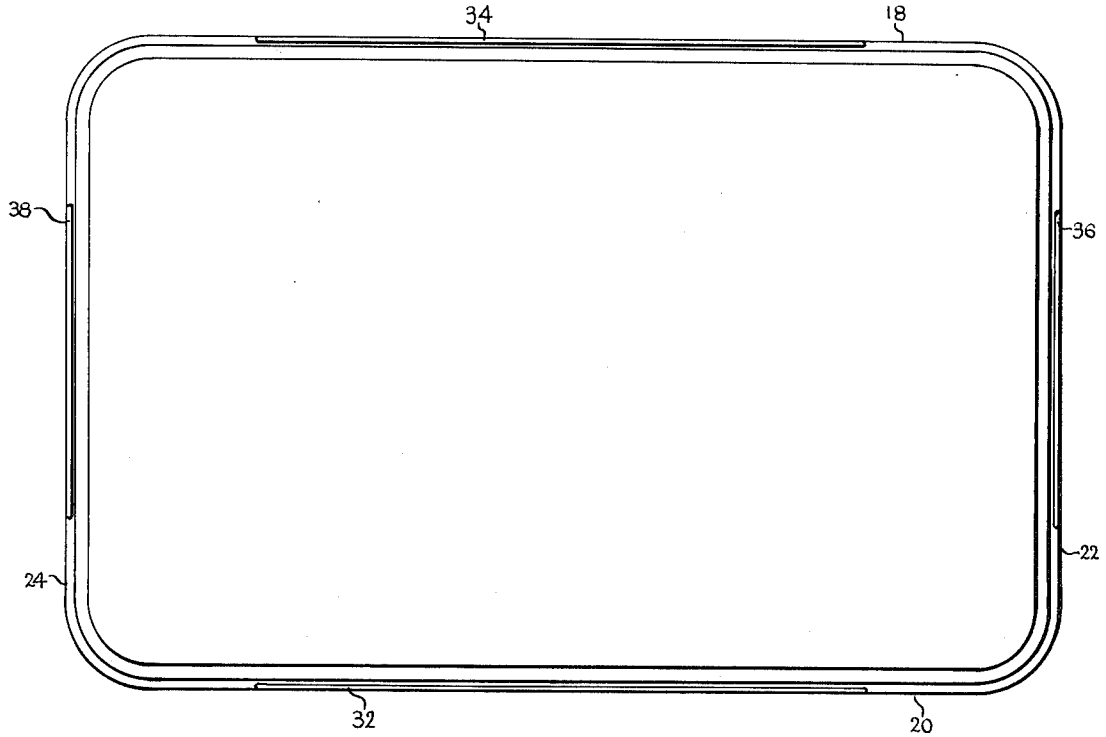
FIG. 2 is a plan view of the modified lens member shown in FIG. 1.
Figure 3:
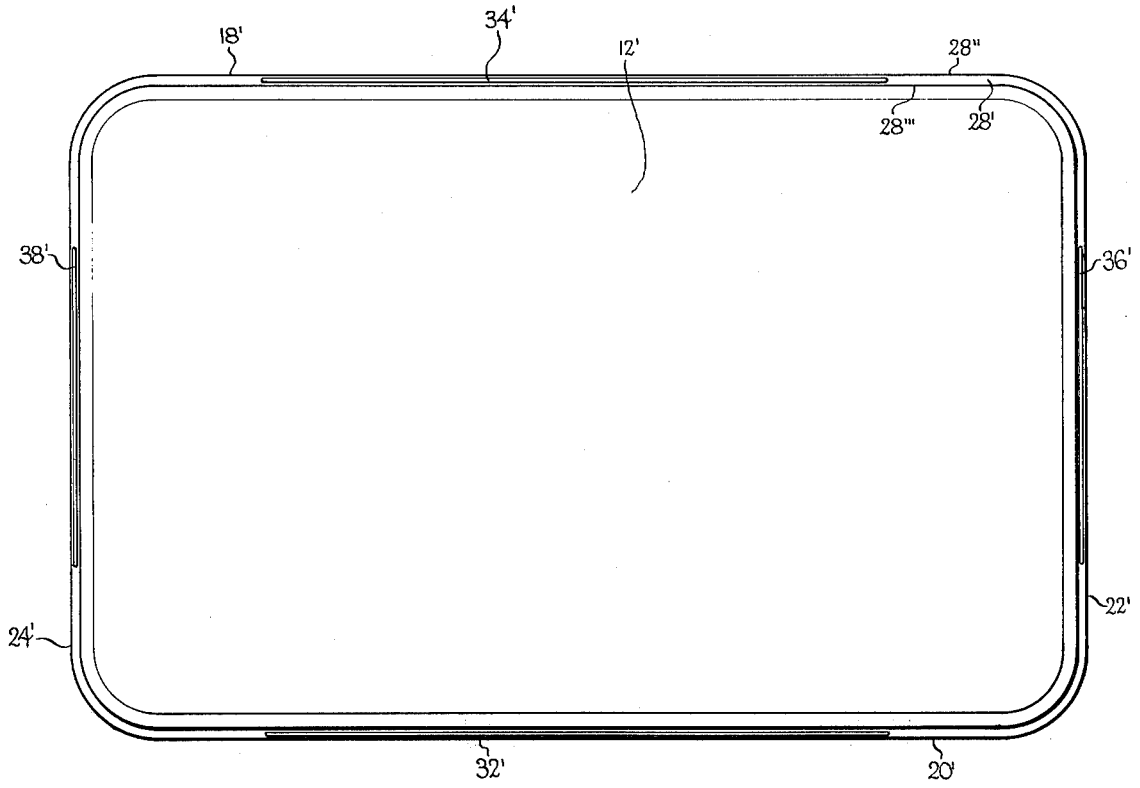
FIG. 3 is a plan view of a further modified lens member according to the present invention.

The segmented construction of the longitudinally extending molded projections in both lens and reflector members of the present sealed beam lamp unit are more clearly shown in FIG. 2. The pressed glass lens member 12 which is depicted includes oppositely disposed projection elements in the form of two pairs of unequal length elements and with the pair of elements 32 and 34 being disposed on the longer sides 18 and 20 of the lens member while a second pair of shorter elements 36 and 38 are disposed on the shorter sides 22 and 24 of said member. As can further be noted, the pair of projections 32 and 34 are approximately equal in length while the pair of elements 36 and 38 are also of approximately equal length. A modification of the above described lens member embodiment is depicted in FIG. 3. Accordingly, pressed glass lens member 12' (which is depicted in plan view) has a first pair of longer length projection elements 32' and 34' disposed on the longer sides 18' and 20' of said lens member along with a second pair of shorter elements 36' and 38' being disposed on the shorter sides 22' and 24' of said member. As can be further noted with respect to the disposition of all said projection elements on the back sealing surface 28' of said member, each element lies inwardly of both the outer rim edge 28'' as well as the inner rim edge 28'''.

It will be apparent from the foregoing description that a generally improved construction has been provided for a rectangular shaped pressed glass sealed beam lamp unit. It will be apparent that modifications can be made in the specific shape or number of projection elements being used other than the preferred segmented construction above specifically described without departing from the true spirit and scope of this invention. For example, it is within present contemplation to employ a plurality of projections on each side of the back sealing surface along with projections similarly disposed but which are of unequal height. Consequently, it is intended to limit the present invention only by the scope of the appended claims.

What we claim as new and desire to secure by Letters Patent of the United States is:

1. A rectangular shaped pressed glass lens for a sealed beam lamp unit which includes a sealing rim having front and back sealing surfaces wherein the improvement comprises a longitudinally extending molded projection disposed on the back sealing surface of said sealing rim intermediate the inner and outer edges.

2. A pressed glass lens as in claim 1 wherein the molded projection has a segmented construction.

3. A pressed glass lens as in claim 2 wherein the segmented construction comprises a plurality of oppositely disposed projection elements.

4. A pressed glass lens as in claim 3 wherein the oppositely disposed projection elements consist of two pairs of unequal length elements and with the pair of said elements being disposed on the longer sides of the rectangular shaped pressed glass lens being of approximately equal length greater than the length of the approximately equal length elements disposed on the shorter sides of said glass lens.

5. A rectangular shaped pressed glass reflector for a sealed beam lamp unit which includes a sealing rim having front and back sealing surfaces wherein the improvement comprises a longitudinally extending molded projection disposed on the back facing surface of said sealing rim intermediate the inner and outer edges.

6. A pressed glass reflector as in claim 5 wherein the molded projection has a segmented construction.

7. A pressed glass reflector as in claim 6 wherein the segmented construction comprises a plurality of oppositely disposed projection elements.

8. A pressed glass reflector as in claim 7 wherein the oppositely disposed projection elements consist of two pairs of unequal length elements and with the pair of said elements being disposed on the longer sides of the rectangular shaped pressed glass lens being of approximately equal length greater than the length of the approximately equal length elements disposed on the shorter sides of said glass lens.

9. A rectangular shaped pressed glass sealed beam lamp unit which includes a rectangular shaped pressed glass lens member having front and back sealing surfaces with a longitudinally extending molded projection disposed on the back sealing surface of said sealing rim intermediate the inner and outer edges and a rectangular shaped pressed glass reflector member also having front and back sealing surfaces with a longitudinally extending molded projection disposed on the back sealing surface of said sealing rim intermediate the inner and outer edges, whereby both rims have been hermetically sealed together at the front facing edges by fusing the glass material so that said projections have disappeared.

10. A rectangular shaped pressed glass sealed beam lamp unit as in claim 9 wherein the molded projections each have a segmented construction.

11. A rectangular shaped pressed glass sealed beam lamp unit as in claim 10 wherein the segmented constructions each comprise a plurality of oppositely disposed projection elements.

12. A rectangular shaped pressed glass sealed beam lamp unit as in claim 11 wherein the oppositely disposed projection elements of each segmented construction consists of two pairs of unequal length elements and with the pair of said elements being disposed on the longer sides of the rectangular shaped pressed glass lens being of approximately equal length greater than the length of the approximately equal length elements disposed on the shorter sides of said glass lens.

13. A rectangular shaped pressed glass sealed beam lamp unit which includes a rectangular shaped pressed glass lens member having front and back sealing surfaces with a longitudinally extending molded projection disposed on the back sealing surface of said sealing rim and a rectangular shaped pressed glass reflector member also having front and back sealing surfaces with a longitudinally extending molded projection disposed on the back sealing surface of said sealing rim, whereby both rims have been hermetically sealed together at the front facing edges by fusing the glass material so that said projections have disappeared.

* * * * *